US006550545B1

(12) United States Patent
Manschitz et al.

(10) Patent No.: US 6,550,545 B1
(45) Date of Patent: Apr. 22, 2003

(54) HAND-HELD ELECTRICAL COMBINATION HAMMER DRILL

(75) Inventors: Erwin Manschitz, Germering (DE); Helmut Burger, Moorenweis (DE); Josef Anzinger, Munich (DE); Manfred Ege, Huglfing (DE); Mathias Doberenz, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 125 days.

(21) Appl. No.: 09/635,282

(22) Filed: Aug. 9, 2000

(30) Foreign Application Priority Data

Aug. 10, 1999 (DE) ..... 199 37 767

(51) Int. Cl.[7] ..... E02D 7/02
(52) U.S. Cl. ..... 173/48; 173/217; 173/170
(58) Field of Search ..... 173/48, 217, 170

(56) References Cited

U.S. PATENT DOCUMENTS

| | | | | | |
|---|---|---|---|---|---|
| 3,854,020 | A | * | 12/1974 | Glover et al. | 200/293.1 |
| 3,873,796 | A | * | 3/1975 | Worobec, Jr. | 200/320 |
| 4,100,383 | A | * | 7/1978 | Piber | 200/1 V |
| 4,232,749 | A | * | 11/1980 | Rohrbach | 173/48 |
| 4,428,438 | A | * | 1/1984 | Holzer | 173/48 |
| 4,537,264 | A | * | 8/1985 | Schmid et al. | 173/109 |
| 4,986,369 | A | * | 1/1991 | Fushiya et al. | 173/178 |
| 5,159,986 | A | * | 11/1992 | Hoser | 173/48 |
| 5,712,543 | A | * | 1/1998 | Sjostrom | 318/67 |
| 5,842,527 | A | * | 12/1998 | Arakawa et al. | 173/104 |
| 5,868,208 | A | * | 2/1999 | Peisert et al. | 173/110 |
| 5,992,257 | A | * | 11/1999 | Nemetz et al. | 464/61 |
| 6,015,017 | A | * | 1/2000 | Lauterwald | 173/109 |
| 6,109,364 | A | * | 8/2000 | Demuth et al. | 173/48 |
| 6,176,321 | B1 | * | 1/2001 | Arakawa et al. | 173/29 |

FOREIGN PATENT DOCUMENTS

GB 2314288 * 12/1997

* cited by examiner

*Primary Examiner*—Rinald I. Rada
*Assistant Examiner*—Louis Tran
(74) *Attorney, Agent, or Firm*—Sidley Austin Brown & Wood, LLP

(57) ABSTRACT

A hand-held electrical combination hammer drill capable of being used both as a drilling hammer and as a chisel hammer, and including an actuation member (17) for actuating an electrical on-off switch of the hammer drill and located on the tool handle switching elements (3, 4) for switching between drilling and chiseling operations, stop elements (5–22) actuated by the switching means (3, 4) for retaining the actuation member (17) in a on-position of the on-off switch upon selection of the chiseling operation, and a stop switch (15) having, upon selection of the chiseling operation, a first position in which the stop switch provides for securing the actuation member (17) in its on-position with the stop elements (5–22), and a second position in which the stop elements occupies a non-operative position in which the actuation member, upon being released, automatically moves into its off-position under an action of a biasing force.

8 Claims, 4 Drawing Sheets

HAND-HELD ELECTRICAL COMBINATION HAMMER DRILL

BACKGROUND OF THE INVENTION

1. Field of the Invention

The present invention relates to a hand-held electrical combination hammer drill capable of being used both as a drilling hammer and as a chisel hammer, and including a housing having a handle, an actuation member for actuating an electrical on-off switch of the hammer drill and located on the handle, a switching element for switching between drilling and chiseling operations, and a stop element actuated by the switching element for retaining the actuation member in an on-position of the on-off switch upon selection of the chiseling operation.

2. Description of the Prior Art

Hammer drills of the type described above, as a rule, has an actuation member provided on the housing handle for actuating an electrical on-off switch and which often simultaneously serves as an adjusting element, e.g., for a potentiometer for, in particular, for effecting a stepless regulation of the electric motor speed, or which is connected with such an adjusting element. When the actuation member is depressed by the user, the motor drive of the hammer drill is turned-on, upon release of the actuation member, the motor drive is turned off.

In many hand-held electrical tools, such as drills, hammer drills, orbital sanders, sabre saws, there is provided a stop knob that locks the actuation member in its on-position. This knob provides for a continuous operation of the tool, so that the actuation member need not be continuously depressed. The stop knob releases the actuation member upon application of a stronger pressure to the actuation member, which is applied when the tool need be turned-off.

Contrary to the conventional electric tools, with hammer drills,.for safety reasons, it is necessary or desirable to retain the actuation member in its on-position only during the chiseling operation, without a possibility of retaining the actuation member in the on-position during the drilling operation when the actuation member is not depressed. In the electrical combination hammer drill disclosed in German Publication DE 19720947A1, this problem is solved by providing, on a rotatable switch knob used for manual switching between the chiseling and drilling operations, a cam which rotates a pivot lever biased against the cam. Upon pivotal movement of the pivot lever, a lock cavity, which is formed thereon, extends into displacement path of a retaining member provided at the free end of a leaf spring secured on a locking pawl for an on-off switch. With this solution, the locking pawl, i.e., the actuation member for the on-off switch, upon actuation of the chiseling operation, becomes positively locked. With the switch knob pivoted by 180°, i.e., during the drilling operation, the cam-actuated pivot lever is pivoted out of the displacement path of the retaining member on the locking pawl, and locking of the locking pawl by the user is not any more possible.

The known solution has encounted numerous practical problems and difficulties. For one, the elements providing for locking of the actuation member during the chiseling operation, the locking cavity, the pivot lever, and the locking spring undergo a different degree of wear because of abrasion, which is caused by pressure applied by engaging each other elements to each other, and due to the fatigue phenomenon of the locking spring. In addition, upon selection of the chiseling operation, after actuation of the locking pawl, the continuous operation is always positively established. Therefore, the user must first release the locking pawl with his hand, if chiseling operation is to be interrupted, in order to place the locking pawl beneath its pivot point. However, there exists a number of chiseling processes when a continuous operation of the chisel is not desirable. E.g., a so-called scabble process when a plurality of discrete short, following one another, chiseling steps are executed. With this process, after removal of the sheeting or the form work, edge overhangs of a concrete construction are removed with an electrical chisel. During such operation, a continuous operation of the tool is not needed and is not desirable.

Accordingly, an object of the present invention is to provide a combination drilling/chiseling hammer drill in which the locking of the switch actuation member does not take place during the drilling operation, however, the chiseling operation can be effected continuously for a long period of time or with interruptions.

This and other objects of the present invention, which will become apparent hereinafter, are achieved by providing a stop switch having, upon selection of the chiseling operation, a first position in which the stop switch provides for securing the actuation member in its on-position with the stop means, and a second position in which the stop means occupies a non-operative position in which the actuation member, upon being released, automatically moves into its off-position under an action of a biasing force.

According to the invention, the hammer drill does not provide for any locking of the actuation member during the drilling operation. If the locking took place prior to the start of the drilling operation, it is compulsory lifted as soon as the drilling operation starts.

For a chiseling operation, according to an advantageous embodiment of the present invention, locking of the actuation member for the on-off switch is possible. This locking can be chosen by the user in advance, and can be selected or turned off also during the operation of the tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

Figure 1:
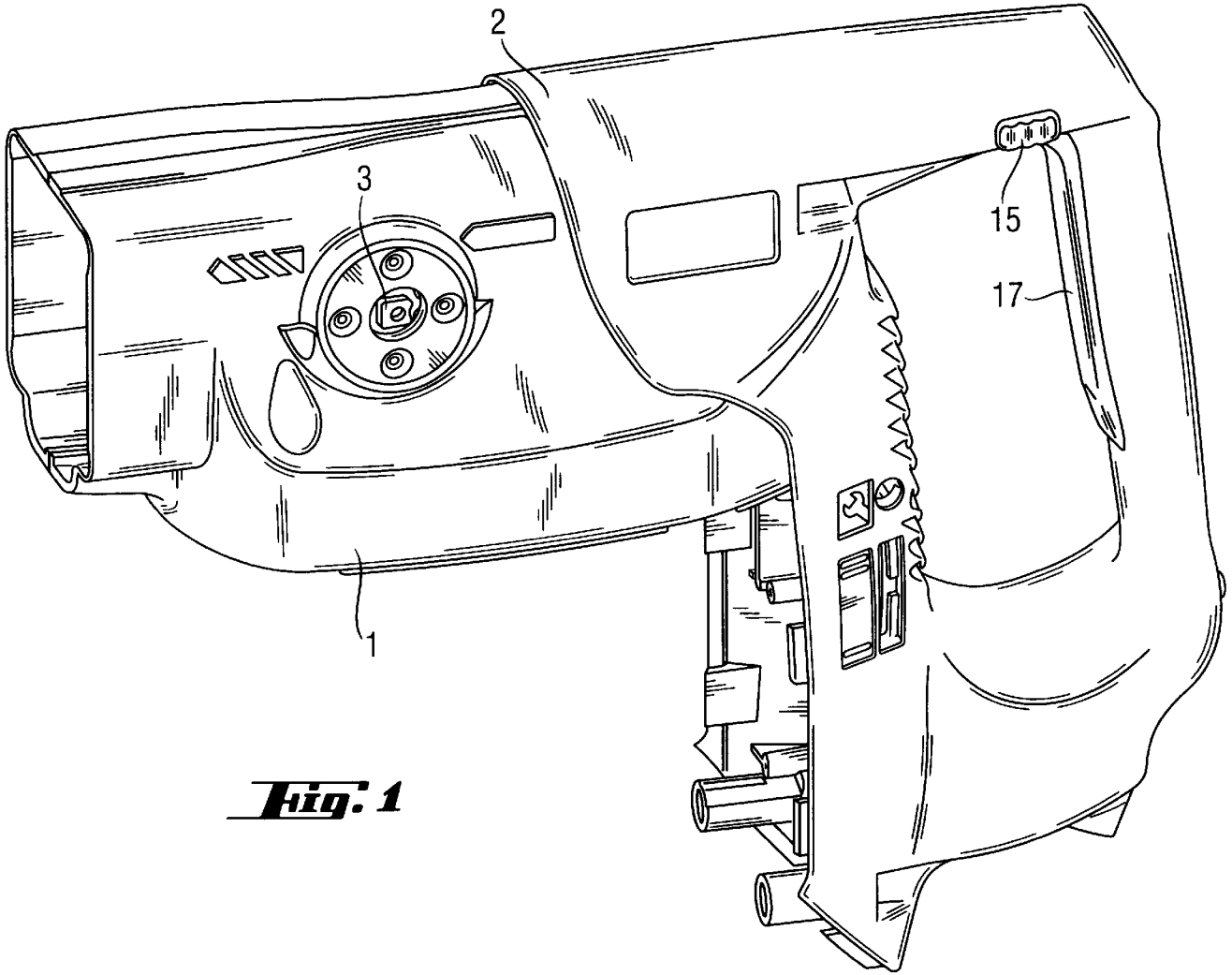
Figure 2:
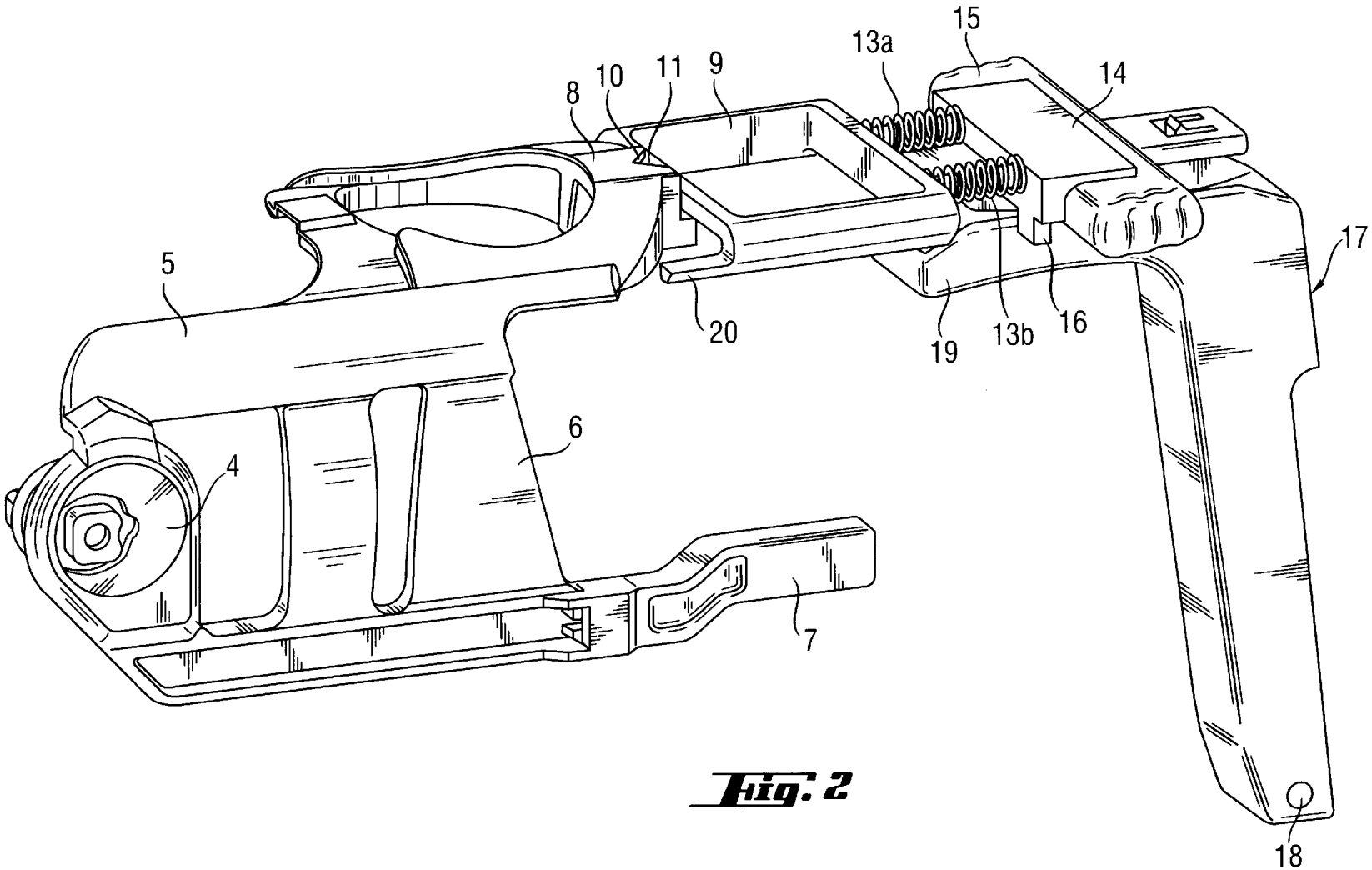
Figure 3A:
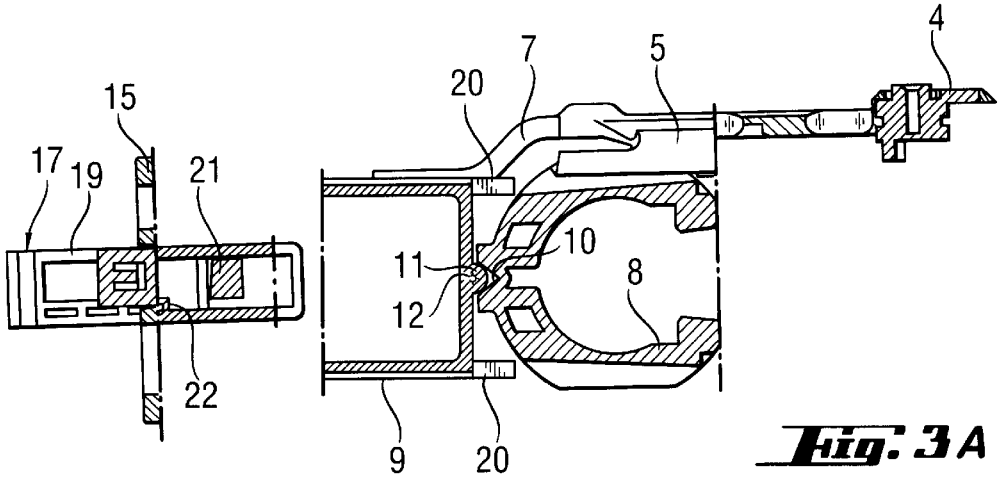
Figure 3B:
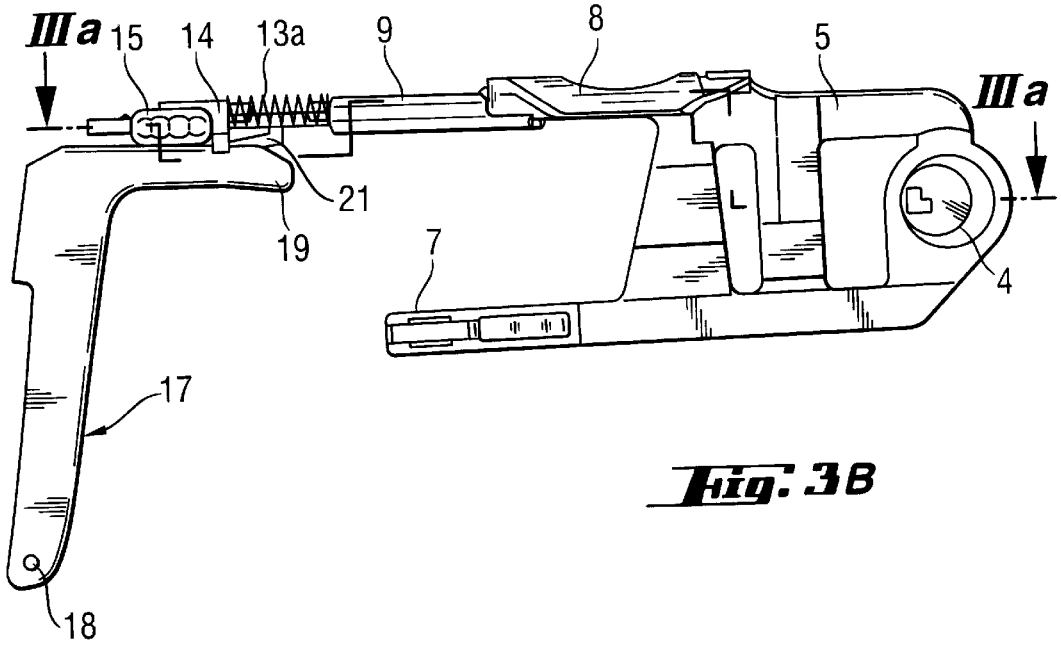
Figure 4A:
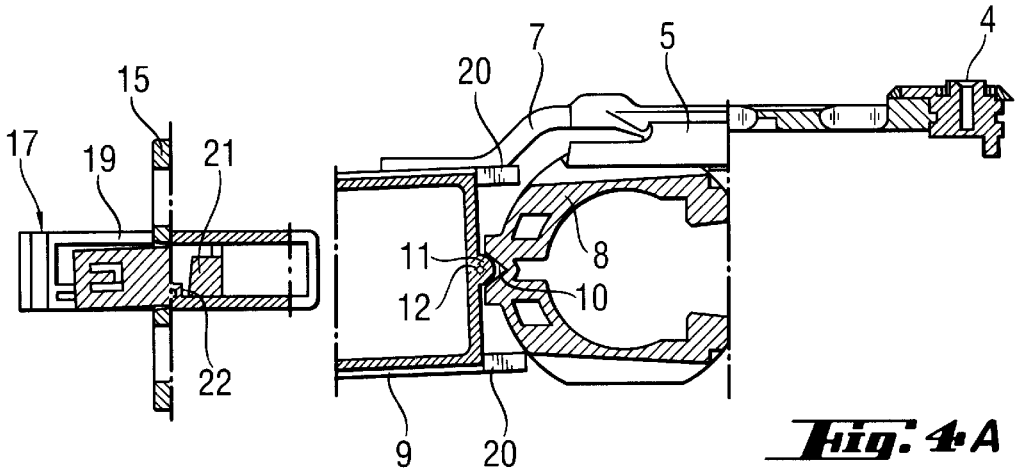
Figure 4B:
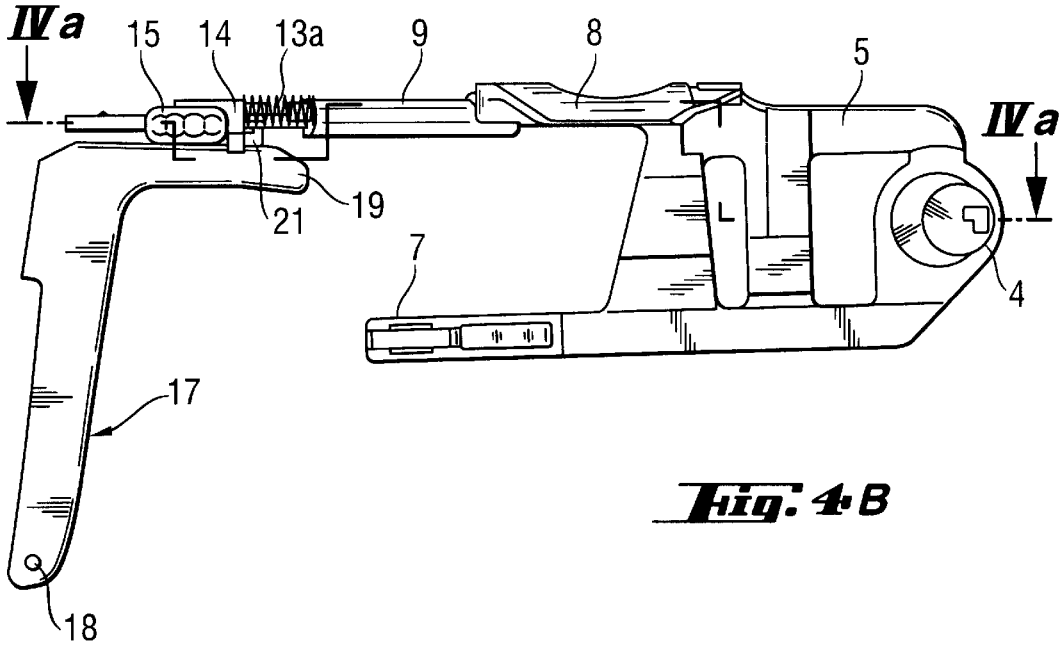

| | |
|---|---|
| FIG. 1 | a perspective view of a housing of an electrical combination hammer drill according to the present invention; |
| FIG. 2 | a perspective view of a switching device for the inventive combination hammer drill with a possibility of random fixation of a switch actuation member upon selection of the chiseling operation; |
| FIG. 3A | a partially cross-sectional plan view of the switching device upon selection of the drilling operation; |
| FIG. 3B | a side view of the switching device likewise during the selected drilling operation; |
| FIG. 4A | a partially cross-sectional plan view of the switching device upon selection of the chiseling operation; and |
| FIG. 4B | a side view of the switching device likewise during the chiseling operation with a selected fixation of the switch actuation member. |

DETAILED DESCRIPTION OF THE PREFERRED EMBODIMENT

In the drawings similar elements are designated with the same reference numerals.

FIG. 1 shows a housing of a hand-held combination hammer drill and which is formed substantially of two parts. One part forms a housing shell 1, and the other part forms a rear handle shell or simply handle 2. On the left side of the housing shell 1, there is provided an opening in which a change-over switch 3 for switching between drilling and chiseling operations is received and is rotatably supported. In the rear portion of the handle 2, above an actuation member 17 for an on/off switch (not shown), there is provided a stop switch 15 that reciprocates transverse to the longitudinal axis of the tool.

FIG. 2 shows a perspective view of the switching device according to the present invention with a possibility of fixation of the switch actuation member 17 upon the selection of the chiseling operation. As shown in FIG. 2, an eccentric 4 is provided on the inner side of the change-over switch 3 supported in the housing shell 1. The eccentric 4 displaces a switch rod 5 relative to the longitudinal axis of the hammer drill against a biasing force of a pair of springs 13*a,* 13*b,* i.e., in a direction toward the actuation member 17, upon rotation of the change-over switch 3 into its "chisel operation" position which is shown in FIGS. 2 and 4A–4B. The switch rod 5 carries a guide plate 8, formed thereon, and has sidewise and downwardly extending arms 6. On the lower side of the arms 6, there is provided a magnet holder 7 longitudinally displaceable together with the switch rod 5. The switch rod 5, the guide plate 8, the arms 6, and the magnet holder 7 rare advantageously formed as a one-piece part of epoxy resin or the like by injection-molding. The switch rod 5 acts on a frame-shaped slide 9 that has, on its transverse spar facing the guide plate 8, a dome-shaped or semi-circular projection 11 engaging in a V-shaped vertical groove 10 formed in the end of the guide plate 8 facing the slide 9. The groove 10 and the projection 11 form together a pivot point about which the slide 9 pivots in a direction transverse to the vertical axis of the combination hammer drill. The pivotal angle lies in a range between 1° and 6°. In a preferred embodiment, the pivotal angle of the slide 11 is 2.7°. The reasons for selecting a pivotal angle of 2.7° will be discussed in detail below. The pivotal angel of the slide 9 is limited by lugs 20 provided on the bottom side of the slide 9. The lugs 20 limit the pivot angle region by engaging the front rounded surface of the guide plate 8. As can be seen in FIG. 2, the two compression springs 13*a,* 13*b,* which bias the slide 9 and the switch rod 5 toward the eccentric 4, are supported against a stop plate 14 which applies a certain pressure, as a result of compression springs 13*a,* 13*b* being supported thereagainst, to the stop switch 15 displaceable transverse to the longitudinal and vertical axes. Stop lugs 16, which are provided on the stop plate 14, limit the displacement of the stop switch 15 in opposite switching directions. The stop lugs 16 act against two, upwardly projecting, side walls of an extension 19 of the actuation member 17, which engages the stop switch 15 from below.

The pivotal slide 9 has, on a bottom side of a web, which is opposite the pivot point 12 (see FIGS. 3A and 4A) and is preferably formed integrally therewith, cam, lug., or hook 21 which pivots, together with the slide 9, about the pivot point 12 transverse to the longitudinal and vertical axes. In the embodiment shown in the drawings, only a cam 21 is shown. The cam 21 is located between the side walls of the extension 19. During the operation of the tool, i.e., in the position of the slide 9 and the switch rod 5 in which they are spaced, under the actions of springs 13*a,* 13*b,* from the stop switch 15, the cam 21 is located outside of a possible displacement path of a stop member 22 provided in the extension 19 of the actuation member 17. During the drilling operation, the stop switch 15 is located in a position shown in FIG. 3*a* in which position, the slide 9 occupies an end position in which it is pivoted leftwards with respect to the longitudinal axis of the hammer drill. In this position, one of the lugs 20 (shown in FIG. 3A in the upper right section of the drawings) engages the guide plate 8 and, adjacent to the cam 21, there remains a free space of several mm, e.g., of 4 mm, due to the selection of the pivot angle of the slide 9 of 2.7°. A stop lug 22 of the actuation member 17 can, therefore, slide through this space when the actuation member 17 is released and pivots about its pivot axis 18 into the off-position under the action of a compression spring (not shown).

Instead of a hinge formed by the groove 10 and the projection 11, the guide plate 8 and the slide 9 can also be formed, as flexible parts, e.g., so that a small pivotal movement of the slide 9 in opposite directions, which is necessary to provide a displacement path for the cam 21, is insured. The cam 21 can also be formed so that it possesses some flexibility, by selecting an appropriate material and/or by its resilient connection with the slide 9. Thereby, in each case, the cam 21 can extend, without any problems, into the operational region of the stop lug 22.

On the other hand, during the chiseling operation (see FIGS. 4A–4B), the slide 9 and, thereby, the cam 21 are located in the position in which the slide 9 has been pivoted leftwardly. When, as shown in FIG. 4A, the stop switch 15 is pressed into its "lock" position, i.e., it is displaced rightwardly along the tool longitudinal axis, and the slide 9 is pivoted into its other end position in which another of the stop lugs 20 engages the guide plate 8, the acting as a stop, cam 21 is located in the path of the rearward displacement of the stop lug 22 provided in the extension 19 of the actuation member 17. This results in the stoppage of the actuation member 17 of the on-off switch, whereby the chiselling operation can take place continuously.

According to the present invention, the stoppage of the continuous operation is possible only when the chiseling operation is selected. However, during the continuous chiseling operation, the stoppage and resumption of the continuous operation can only be effected after actuation of the chisel drive by actuation of the stop switch 15. If, e.g., during the chiseling operation, the stop switch 15 has not yet attained its stop position shown in FIG. 4A, the cam 21 remains in its lifted, with respect to the stop lug 22, position so that, upon release of the actuation member 17, the stop lug 22 can slide past the cam 21, with the drive being turned off.

If the user wants, after the start of the chiseling operation, to put the hammer drill into a continuous mode, it pushes the stop switch 15 in the longitudinal direction rightwardly into the position shown in FIG. 4A. Then, the actuation member 17 can be released, as the return displacement of the actuation member 17 and, thus, the switching-off of the tool is prevented. When the user switches from the chiseling operation to the drilling operation or displaces the stop switch 15 leftward along the tool longitudinal axis, i.e., into the position shown in FIG. 3A, the displacement path of the stop lug 22 becomes free, and the actuation member 17, upon release, always moves into the off-position.

The magnet holder 7, which is connected with the switch rod 5 by the arms 6, serves for supporting, at its free end (FIG. 2), a switching magnet, in particular a permanent magnet or another element for switching the tool drive electronics between drilling and chiseling operations, e.g., an optical or electromagnetic switching element that performs its switching function due to cooperation of two components. In case a magnetic switch is used, the magnet, which is supported in the magnet holder 7 and is displaceable therewith, cooperates with a Hall sensor (not shown) for switching the drive electronic between the drilling and chiseling operations.

The present invention provides a switching and stop device suitable for use in, as a rule, "rough" combination hammer drill and insuring its stable and long-lasting use. The inventive device insures an immediate stoppage of the drilling operation upon release of the switch actuation member, while insuring a continuous chiseling operation, upon release of the switch actuation member, by appropriate positioning of the stop switch.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A hand-held electrical combination hammer drill capable of being used both as a drilling hammer and as a chisel hammer, comprising a housing having a handle (2); an actuation member (17) for actuating an electrical on-off switch of the hammer drill and located on the handle (2); switching means (3, 4) for switching between drilling and chiseling operations; stop means (5–22) actuated by the switching means (3, 4) for retaining the actuation member (17) in a on-position of the on-off switch upon selection of the chiseling operation; and a stop switch (15) having, upon selection of the chiseling operation, a first position in which the stop switch provides for securing the actuation member (17) in the on-position thereof with the stop means (5–22), and a second position in which the stop means occupies a non-operative position in which the actuation member, upon being released, automatically moves into the off-position thereof under an action of a biasing force, wherein the stop means comprises a slide (9), and a switch rod (5) displaceable in a longitudinal direction of the hammer drill by the switching means (3, 4) for displacing the slide (9) in the longitudinal direction of the hammer drill by the switching means (3, 4), and wherein the slide (9) is provided, at a side thereof opposite the switch rod (5), with a stop member (21) which upon displacement of the stop switch (15) into the "chiseling operation" position thereof, extends into a displacement path of a stop lug (22) provided on the actuation member (17), preventing return of the actuation member (17) in the off-position thereof.

2. A hammer drill according to claim 1, wherein the stop means includes an articulated joint (10,11,12) provided between the switch rod (5) and the slide (9).

3. A hammer drill according to claim 1, wherein the stop member (21) is formed as one of hook, lug, and cam that, upon selection of the chiseling operation and securing of the actuation member (17)—actuating stop switch (15), extends into a return path of the stop lug (22) provided on the actuation member (17).

4. A hammer drill according to claim 3, wherein the switching means (3, 4) comprises an eccentric (4) that, upon the selection of the chiseling operation, displaces, via a switch rod (5), the slide (9) in a direction toward the actuation member (17) against a biasing force of spring means **(13*a*, 13*b*)**.

5. A hammer drill according to claim 4, wherein the spring means **(13*a*, 13*b*)** comprises two compression springs arranged in a same plane, parallel to each other.

6. A hammer drill according to claim 5, wherein the two compression springs are supported against the stop plate (14) and act on a surface of the slide (9) opposite a pivot point (12) of the slide.

7. A hammer drill according to claim 1, further comprising a magnet holder (7) for supporting means for communicating to control electronics of the hammer drill a logical yes/no switching signal dependent on a switching position of the switching means, the magnet holder being connected with the switch rod (5) for joint longitudinal displacement therewith.

8. A hammer drill according to claim 2, wherein the stop means further comprises a stop plate (14) for limiting displacement of the stop switch (15) is a respective one of the first and second positions thereof.

* * * * *